US010026305B2

(12) United States Patent
Saegusa et al.

(10) Patent No.: US 10,026,305 B2
(45) Date of Patent: Jul. 17, 2018

(54) COMMUNICATION CONTROL DEVICE

(71) Applicant: Futaba Corporation, Mobara-shi, Chiba-ken (JP)

(72) Inventors: Masahiro Saegusa, Mobara (JP); Chihiro Uemura, Mobara (JP)

(73) Assignee: FUTABA CORPORATION, Mobara-Shi, Chiba-Ken (JP)

( * ) Notice: Subject to any disclaimer, the term of this patent is extended or adjusted under 35 U.S.C. 154(b) by 0 days.

(21) Appl. No.: 15/461,524

(22) Filed: Mar. 17, 2017

(65) Prior Publication Data

US 2017/0301227 A1 Oct. 19, 2017

(30) Foreign Application Priority Data

Apr. 19, 2016 (JP) ..... 2016-083597

(51) Int. Cl.
*G08C 17/02* (2006.01)

(52) U.S. Cl.
CPC ..... *G08C 17/02* (2013.01); *G08C 2201/70* (2013.01)

(58) Field of Classification Search
CPC ..... G08C 17/02
USPC ..... 340/12.5
See application file for complete search history.

(56) References Cited

U.S. PATENT DOCUMENTS 6,870,936 B1 * 3/2005 Ajamian ..... G11B 27/034 348/E5.057
2002/0163905 A1 11/2002 Brabrand
2004/0245378 A1 * 12/2004 Nonami ..... A63H 27/12 244/17.13
2005/0027406 A1 * 2/2005 Nonami ..... G05D 1/0033 701/3
2010/0119085 A1 * 5/2010 Shimizu ..... H04S 1/007 381/119
2014/0170990 A1 6/2014 Black et al.

OTHER PUBLICATIONS

Office Action Issued in Taiwan Appln. No. 106109758 dated Nov. 8, 2017.

* cited by examiner

*Primary Examiner* — Allen T Cao
(74) *Attorney, Agent, or Firm* — Bacon & Thomas, PLLC

(57) ABSTRACT

A communication control device is used for a radio control model equipped with a plurality of receiving devices configured to receive operation signals from corresponding transmitting devices and a drive control device configured to perform drive control with respect to a driving target based on the operation signals. The communication control device includes an input unit for inputting signals including the operation signals from the receiving devices, and a switching processing unit for performing a process of switching an operation signal to be transmitted to the drive control device from any one of the operation signals inputted by the receiving devices to another operation signal.

12 Claims, 12 Drawing Sheets

100A (RADIO CONTROL SYSTEM)

COMMUNICATION CONTROL DEVICE

FIELD OF THE INVENTION

The present invention relates to a communication control device for a radio control model including a plurality of receiving devices each of which is configured to receive an operation signal from a corresponding transmitting device and a drive control device configured to perform drive control with respect to a driven target based on the operation signal.

BACKGROUND OF THE INVENTION

For example, various radio control models simulating airplanes, helicopters, cars, ships, robots and the like are known. In the case of causing a radio control model to fly or run, an operator operates an operation element such as an operation stick or the like provided in an operation-purpose radio device (transmitting device). The transmitting device generates an operation signal corresponding to the operation amount of the operation element and transmits the operation signal to the radio control model.

The radio control model is equipped with a receiving device configured to receive the operation signal and a controller (drive control device) configured to, based on the operation signal, control actuator devices (drive units) such as, e.g., servomotors or the like, for driving respective mechanisms of the radio control model.

The operation signal received by the receiving device from the transmitting device is delivered to the drive control device. The drive control device controls the drive units based on the operation signal. As a result, the operator can remotely control the radio control model.

Depending on the application of the radio control model, it may be required to have the radio control model fly or run a relatively wide range. For example, when obtaining a captured image of a site difficult to enter, such as a disaster site or the like, using a radio control model such as a helicopter or a multicopter equipped with a camera device, if the site is relatively wide, the flight range of the radio control model becomes extensive.

For the related prior art, reference is made to Japanese Patent Application Publication No. 2010-005121.

Since there is a limit to the range in which the radio control model can be operated with only one transmitting device, it is conceivable to adopt a method in which a plurality of operators (and transmitting devices) is disposed at a distance from each other so that each person operates a radio control model moved into the corresponding region.

However, according to the conventional receiving device, in a state in which the radio control model starts flying or running and moves away from an operator after the receiving device is linked to a certain transmitting device (communication ID) (so that the receiving device can receive an operation signal), it is difficult to cancel the link and change the link destination to another transmitting device (communication ID). Thus, it is difficult for the conventional receiving device to cope with the method in which the radio control model is operated by a plurality of persons as mentioned above.

The conventional receiving device may perform frequency hopping in the communication with the transmitting device side. In that case, if a plurality of transmitting devices sets (selects) a common communication ID, in the course of moving the radio control model, the signal reception level of a certain transmitting device (the transmitting device getting far away from the radio control model) tends to decrease and the signal reception level of another transmitter (the transmitting device getting close to the radio control model) tends to increase. As a result, there is a possibility that it becomes possible to receive an operation signal from another transmitting device after an operation signal from a certain transmitting device becomes unreceivable.

However, such a usage method is not the originally assumed usage method. It is uncertain whether it is possible to reliably receive the operation signal from another transmitting device. Even if the operation signal can be received from another transmitting device, it may take a relatively long time to search for a frequency band in which the radio control model can communicate with another transmitting device. In that case, the time in which the radio control model is in a non-operation state (so-called no-control state) becomes longer. In other words, there is a fear that the risk of crash or the like increases.

SUMMARY OF THE INVENTION

It is therefore an object of the present invention to overcome the above-mentioned problems and to improve the safety when enabling a plurality of transmitting devices to alternately operate a common radio control model.

In accordance with an aspect, there is provided a communication control device for a radio control model equipped with a plurality of receiving devices configured to receive operation signals from corresponding transmitting devices and a drive control device configured to perform drive control with respect to a driving target based on the operation signals, the communication control device including: an input unit configured to input signals including the operation signals from the receiving devices; and a switching processing unit configured to perform a process of switching an operation signal to be transmitted to the drive control device from any one of the operation signals inputted by the receiving devices to another operation signal.

As described above, by performing the switching of the operation signals inputted from the receiving devices in the case of using the plurality of receiving devices configured to receive the operation signals from the corresponding transmitting devices, it is possible to smoothly perform the switching of the transmitting devices.

In the communication control device, the switching processing unit may be configured to perform the switching based on a specific operation signal transmitted by one of the transmitting devices in response to a specific operation input and received by the receiving device corresponding to the one of the transmitting devices.

As a result, the switching can be performed while reflecting the intention of the operator.

In the communication control device, the switching processing unit may be configured to, in response to the specific operation signal transmitted by the transmitting device of a switching source, perform switching to an operation signal transmitted from a transmitting device other than the transmitting device of the switching source. As a result, the switching can be performed while reflecting the intention of the operator of the switching source.

In the communication control device, the switching processing unit may be configured to perform switching to an operation signal transmitted from the transmitting device which has transmitted the specific operation signal.

This eliminates the need to, when performing the switching, check whether the transmitting device of the switching destination is in a receivable state.

In the communication control device, the switching processing unit may be configured to perform the switching based on a reception state of the operation signal transmitted by each of the transmitting devices.

As a result, it is possible to prevent the switching from being performed in a state in which it is difficult for the transmitting device of the switching destination or the switching source to appropriately perform the model operation.

In the communication control device, the switching processing unit may be configured to perform the switching based on the duration of a state in which an operation signal transmitted by the transmitting device of a switching source is unreceivable.

Thus, it is possible to automatically (not manually) perform the switching before a state in which it is difficult for the transmitting device of the switching source to properly operate the radio control model lasts for a relatively long time.

In the communication control device, each of the receiving devices may be configured to be able to perform bidirectional communication with each of the transmitting devices and the communication control device, and the communication control device may further include: a notification processing unit configured to perform information transmission to the receiving device corresponding to one of the transmitting devices serving as a subject for transmitting an operation signal to the drive control device so that notification information is transmitted to the one of the transmitting devices serving as the transmission subject for the operation signal.

As a result, the fact that the radio control model is operable can be notified to the operator of one of the transmitting devices currently capable of operating the radio control model.

The communication control device may further include: an information transmission processing unit configured to perform information transmission to the receiving device corresponding to another transmitting device so that reception level information on the operation signal transmitted by the another transmitting device is transmitted to one of the transmitting devices.

As a result, when there are two transmitting devices, the operator of one of the switching source and the switching destination can grasp the reception level of the other party. If the reception level information of the switching destination is transmitted to the switching source, the operator of the switching source can determine whether the switching destination is in a switchable state in terms of the reception level. Moreover, if the reception level information of the switching source is transmitted to the switching destination, the operator of the switching destination can determine whether switching is about to be performed from now, particularly when it is difficult to communicate between the operators existing far away from the switching source. When there are three or more transmitting devices, if the reception level information of another transmitting device is transmitted to the switching source, the operator of the switching source can easily determine to which transmitting device is to be switched. In addition, if the reception level information of the switching source is transmitted to the transmitting device other than the switching source, the operator other than the switching source can easily determine whether switching to him or her is about to be performed from now, particularly when it is difficult to communicate between the operators existing far away from the switching source. In this way, by making sure that, to one of the transmitting devices, the reception level information of the operation signal transmitted by another transmitting device is transmitted, it is possible to prevent confusion of the operator at the time of switching.

In the communication control device, each of a first signal transmission path as a signal transmission path leading to each of the receiving devices and a second signal transmission path as a signal transmission path leading to the drive control device may have a plurality of transmission channels, and the communication control device may further include: an extraction unit configured to extract a transmission signal of a part of the transmission channels allocated to each of the receiving devices from transmission signals inputted to the receiving devices by the input unit via the first signal transmission path; and a mixed transmission unit configured to allocate the transmission signal extracted by the extraction unit to a corresponding part of the transmission channels of the second signal transmission path and transmit the allocated transmission signal to the drive control device.

Thus, the transmission signals from the respective transmitting devices are transmitted to the drive control device in a state in which the transmission signals are allocated to the predetermined channels of the second signal transmission path.

In the communication control device, the switching processing unit may be configured to perform the switching based on a driving amount of a driving target represented by an operation signal transmitted by one of the transmitting devices and received by the receiving device corresponding to one of the transmitting devices.

As a result, at the time of switching, the driving amount of the driving target designated by the transmitting device of the switching source or another transmitting device capable of becoming the switching destination is taken into consideration.

In the communication control device, the switching processing unit is configured to perform the switching under a condition that a difference between a driving amount represented by an operation signal transmitted by the transmitting device of a switching source and received by the receiving device corresponding to the transmitting device of the switching source and a driving amount represented by an operation signal transmitted by the transmitting device other than the switching source and received by the receiving device corresponding to the transmitting device other than the switching source is equal to or smaller than a predetermined value.

This makes it possible to prevent the driving amount of the driving target from relatively greatly deviating before and after the switching.

In the communication control device, the switching processing unit may be configured to perform the switching on a condition that a driving amount represented by an operation signal transmitted by the transmitting device of a switching source and received by the receiving device corresponding to the transmitting device of the switching source is equal to or smaller than a predetermined value.

Thus, it is possible to prevent the switching from being performed in a state in which the driving amount represented by the operation signal of the switching destination is greatly deviated from a driving amount assumed at the time of switching.

Effect of the Invention

In accordance with the present invention, it is possible to improve the safety when enabling the plurality of transmitting devices to alternately operate a common radio control model.

DETAILED DESCRIPTION OF THE EMBODIMENTS

Hereinafter, embodiments of the present invention will be described in the following order.

<1. Radio Control System of the Embodiment>
(1-1. System Overview)
(1-2. Configuration of Transmitting Device)
(1-3. Configuration of Radio Control Model)
(1-4. Configuration and Function of Communication control device)
(1-5. Processing Procedure)
<2. Modifications of the Embodiment>
(2-1. Modification 1)
(2-2. Modification 2)
(2-3. Other)
<3. Summary of the Embodiment>
<4. Other Modifications>

1. RADIO CONTROL SYSTEM OF THE EMBODIMENT (1-1. System Overview)

Figure 1:
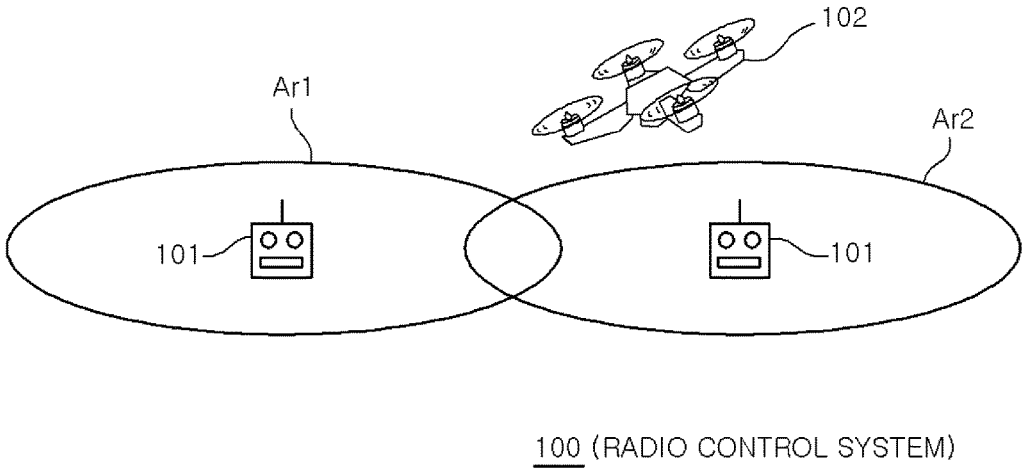
FIG. 1 is a view showing an external configuration example of a radio control system provided with a communication control device according to an embodiment of the present invention.

FIG. 1 shows an external configuration example of a radio control system 100 including a communication control device 1 according to an embodiment of the present invention. As shown in FIG. 1, the radio control system 100 includes two transmitting devices 101 and a radio control model 102. In this example, the radio control model 102 is in the form of a multicopter.

The transmitting device 101 is provided with an operation element such as an operation stick or the like through which an input operation is performed by an operator who operates the radio control model 102. The transmitting device 101 wirelessly transmits an operation signal corresponding to the operation amount of the operation element to a receiver (a receiving device 2 to be described later) mounted on the radio control model 102. In addition, the transmitting device 101 of this example is capable of receiving the signal transmitted by the receiving device 2.

As will be described later, the transmitting device 101 includes a display unit 113. The information corresponding to the reception signal received from the receiving device 2 can be visually presented to the operator through the display unit 113.

In FIG. 1, the areas in which the receiving devices 2 mounted on the radio control model 102 can receive transmission signals from the transmitting devices 101 are schematically shown as receivable areas Ar1 and Ar2, respectively.

In the radio control system 100, the transmitting devices 101 are disposed in a separated relationship with each other on the condition that the receivable areas Ar1 and Ar2 partially overlap with each other.

(1-2. Configuration of Transmitting Device)

Figure 2:
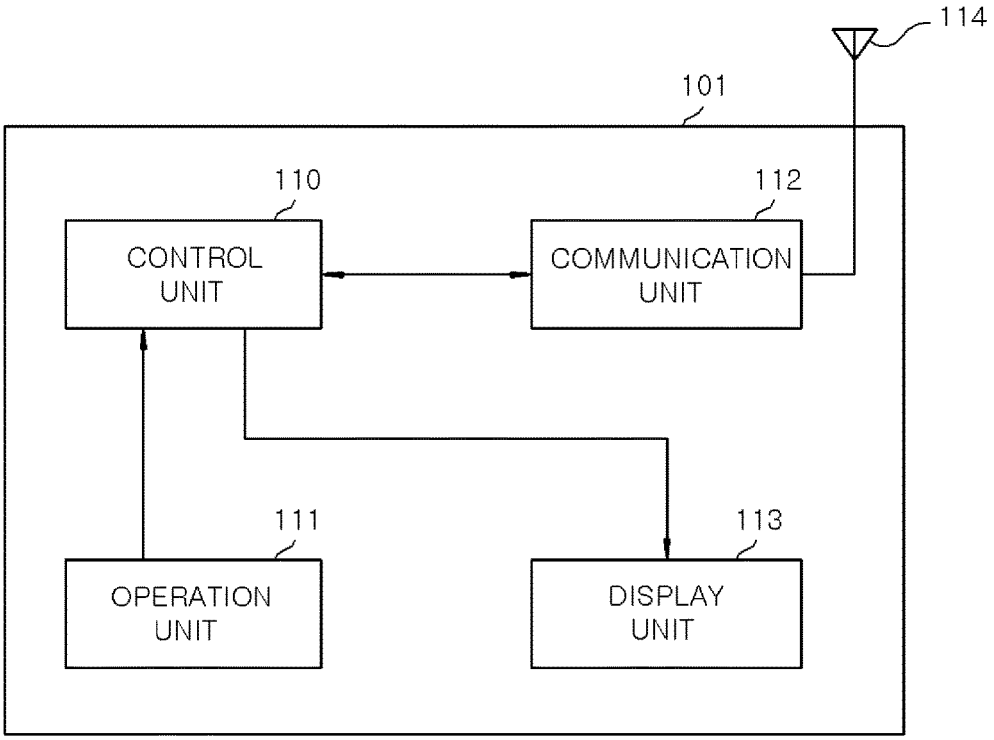
FIG. 2 is a block diagram showing an internal configuration of a transmitting device included in the radio control system according to an embodiment.

FIG. 2 is a block diagram showing the internal configuration of the transmitting device 101. The transmitting device 101 includes a control unit 110, an operation unit 111 connected to the control unit 110, a communication unit 112, and a display unit 113. The transmitting device 101 further includes an antenna 114 connected to the communication unit 112.

The operation unit 111 includes an operation element such as the aforementioned operation stick or the like for performing an operation related to the flight of the radio control model 102 and an operation element such as an operation button or the like for performing other operations. A signal corresponding to an operator's operation input performed using these operation elements is acquired by the control unit 110.

The communication unit 112 is configured to be able to transmit and receive signals to and from an external device (particularly, the receiving device 2) via the antenna 114 in a predetermined wireless communication manner.

The display unit 113 includes a display such as, e.g., an LCD (Liquid Crystal Display), an organic EL (Electro-Luminescence) or the like, and displays various kinds of information under the control of the control unit 110.

The control unit 110 includes an information processing device such as a microcomputer including a CPU (Central Processing Unit) and a memory such as ROM (Read Only Memory), RAM (Random Access Memory) or the like. The control unit 110 performs overall control of the transmitting device 101 by performing a process according to a program stored in the memory such as the ROM or the like.

For example, the control unit 110 causes the communication unit 112 to transmit an operation signal corresponding to the operation amount of the flight-related operation element provided in the operation unit 111 to the external device via the antenna 114.

In the following description, unless specifically mentioned otherwise, when saying "operation signal", it refers to an operation signal corresponding to the aforementioned operation amount.

Furthermore, the control unit 110 performs control so that the corresponding information is displayed on the display unit 113 based on the signal received by the communication unit 112 from the external device.

(1-3. Configuration of Radio Control Model)

Figure 3:
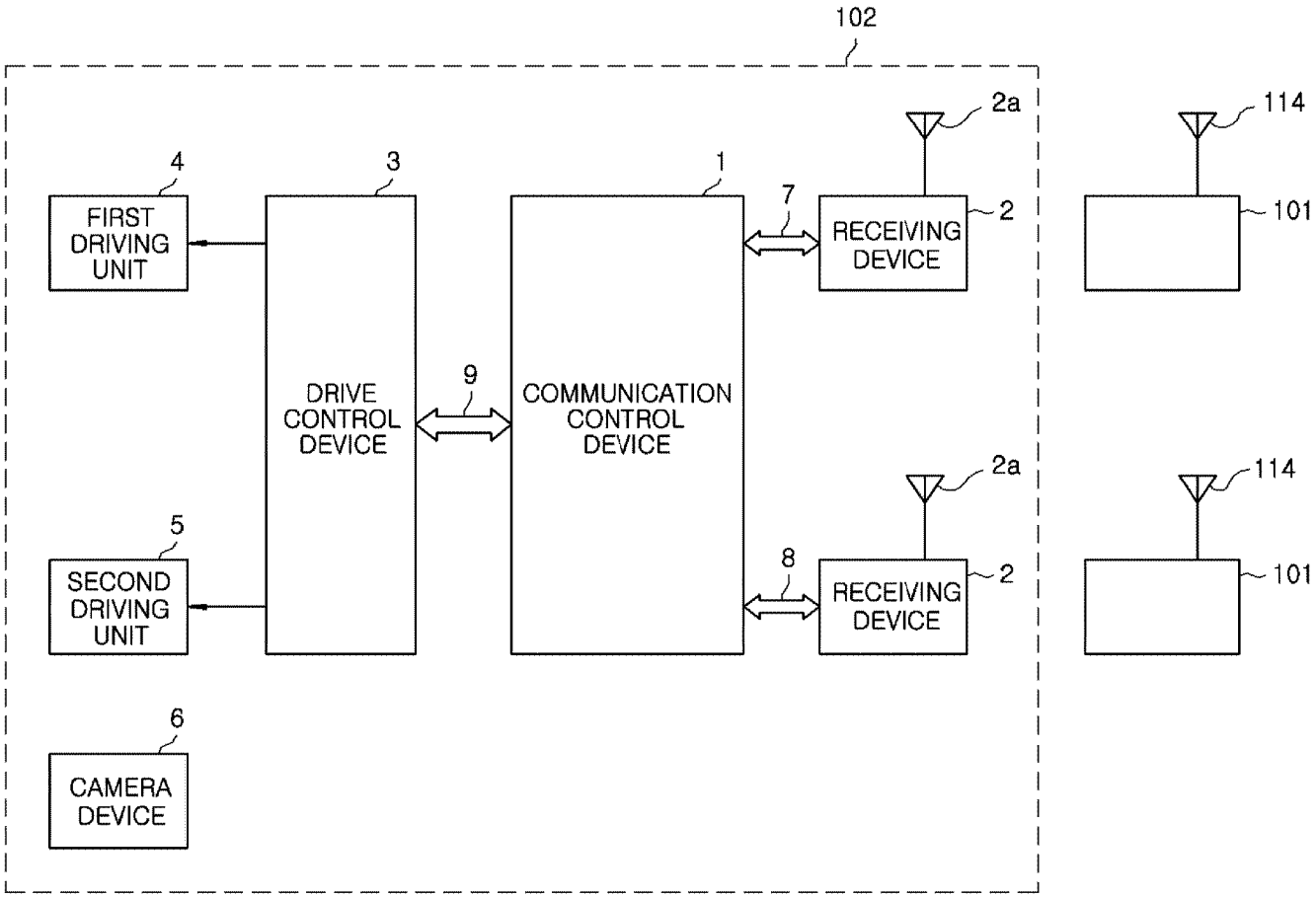
FIG. 3 is a block diagram showing an internal configuration of a radio control model according to an embodiment.

FIG. 3 is a block diagram showing the internal configuration of the radio control model 102. In FIG. 3, the transmitting devices 101 are also shown. In the radio control model 102, two receiving devices 2 are mounted as the receiving devices corresponding to the two transmitting devices 101, respectively. A communication control device 1, a drive control device 3, a first driving unit 4, a second driving unit 5 and a camera device 6 are mounted to the radio control model 102. It should be noted that the camera device 6 is mounted as necessary. The flight may be performed in a state in which the camera device 6 is not mounted.

One of the two receiving devices 2 is connected to the communication control device 1 through a wiring line 7. The other receiving device 2 is connected to the communication control device 1 through a wiring line 8. The communication control device 1 and the drive control device 3 are connected by a wiring line 9. In this example, serial data communication is performed between the receiving device 2 and the communication control device 1 and between the communication control device 1 and the drive control device so that data signals of a plurality of channels can be transmitted at the same time.

In the case of this example, it is assumed that the number of transmission channels in the signal transmission path between the receiving device 2 and the communication control device 1 and between the communication control device 1 and the drive control device 3 is "8".

The receiving device 2 includes an information processing device such as a microcomputer provided with a CPU and a memory such as a ROM, a RAM or the like. The receiving device 2 further includes an antenna 2*a* for performing bidirectional communication with the transmitting device 101 in a predetermined wireless communication manner.

The receiving device 2 receives a transmission signal from the transmitting device 101 linked in advance. The link referred to herein means the establishment of a state in which signal communication can be performed between the receiving device 2 and the transmitting device 101. The link is performed based on the operation by the operator. For example, the link is performed as the operator performs a predetermined operation through the operation unit 111 of the transmitting device 101 in a state in which a pair of the receiving device 2 and the transmitting device 101 is connected by, for example, a cable or the like.

The transmitting device 101 has a unique communication ID (identification information). The transmitting device 101 transmits a signal including a unique communication ID to the receiving device 2. The receiving device 2 identifies the transmission signal sent from the transmitting device 101 of the link destination based on the communication ID included in the transmission signal of the transmitting device 101.

Furthermore, when transmitting a signal to the transmitting device 101, the receiving device 2 transmits a signal including the communication ID of the transmitting device 101 of the link destination. As a result, the transmitting device 101 can identify the transmission signal sent from the receiving device 2 of the link destination.

When failing to receive the transmission signal (including the operation signal) from the transmitting device 101 of the link destination, the receiving device 2 outputs information indicating such a fact to the rear stage side (the side of the communication control device 1). In the case of this example, as the standard of signal transmission between the receiving device 2 and the communication control device 1 and between the communication control device 1 and the drive control device 3, a predetermined bit of the transmission signal in a predetermined transmission channel is allocated as a "reception status bit". When failing to receive the transmission signal from the transmitting device 101 of the link destination, the receiving device 2 causes the reception status bit to become ON (for example, "1"). When receiving the transmission signal, the receiving device 2 causes the reception status bit to become OFF (for example, "0").

Furthermore, the receiving device 2 detects the reception level of the transmission signal sent from the transmitting device 101 of the link destination and outputs the information on the detected reception level (hereinafter referred to as "reception level information") to the latter stage side (the side of the communication control device).

In the following description, one side of two sets of the transmitting device 101 and the receiving device 2 respectively linked will be referred to as "primary side" and the other side of two sets will be referred to as "secondary side". In this example, it is assumed that the set including the receiving device 2 connected to a below-described first terminal unit 11 of the communication control device 1 is the primary side.

The communication control device 1 performs communication control between the receiving device 2 and the drive control device 3. The internal configuration of the communication control device 1 will be described later again.

The first driving unit 4 comprehensively represents actuator devices such as servomotors or the like for driving drive mechanisms such as, e.g., a propeller and the like related to the flight of the radio control model 102.

Furthermore, the second driving unit 5 comprehensively represents actuator devices such as motors for driving mechanisms (for example, a panning mechanism, a tilting mechanism, etc.) for controlling the imaging direction of the camera device 6 provided in the radio control model 102.

Similar to the camera device 6, the second driving unit 5 may not be mounted on the radio control model 102 in some cases.

The drive control device 3 includes an information processing device, for example, a microcomputer provided with a CPU and a memory such as a ROM, a RAM or like. The drive control device 3 performs drive control of various actuator devices as the first driving unit 4 and/or the second driving unit 5 on the basis of the operation signal transmitted by the transmitting device 101 and inputted via the receiving device 2 and the communication control device 1.

The drive control device 3 in this example has two modes, a "first mode" and a "second mode", as operation modes related to the drive of the driving unit. The "first mode" is a mode in which the drive of the first driving unit is controlled using all the channel signals among the inputted multi-channel signals (8 channel signals in this example). On the other hand, the "second mode" is a mode in which the drive of the first driving unit 4 is controlled using some channel signals among the inputted multi-channel signals and the drive of the second driving unit 5 is controlled using the remaining channel signals. Specifically, in this example, the second mode is a mode in which the drive of the first driving unit 4 is controlled using 0-channel to 3-channel signals and the drive of the second driving unit 5 is controlled using the remaining 4-channel to 7-channel signals.

The mode setting of the first and second modes is performed based on the operation of the operator. For example, similar to the link described above, the mode setting is performed by connecting the drive control device and the transmitting device 101 through a cable and operating the operation unit 111.

In the following description, unless specifically mentioned otherwise, it is assumed that the mode of the drive control device 3 is the first mode.

(1-4. Configuration and Function of Communication Control Device)

Figure 4:
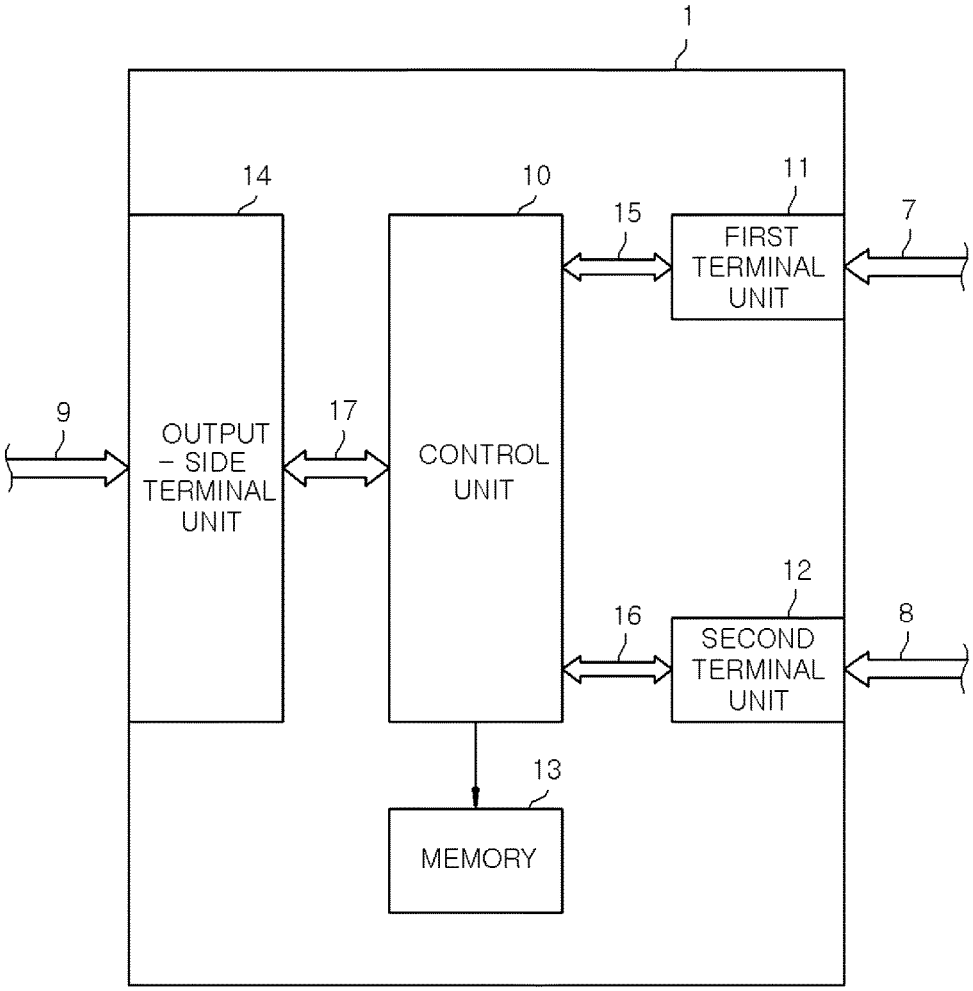
FIG. 4 is a block diagram showing an internal configuration of a communication control device according to an embodiment.

FIG. 4 is a block diagram showing the internal configuration of the communication control device 1. In FIG. 4, the wiring lines 7, 8 and 9 shown in FIG. 3 are also shown.

As shown in FIG. 4, the communication control device 1 includes a control unit 10, a first terminal unit 11, a second terminal unit 12, a memory 13 and an output-side terminal unit 14.

Each of the first terminal unit 11, the second terminal unit 12 and the output-side terminal unit 14 is a terminal unit having a plurality of terminals corresponding to multi-channel signal communication. The wiring line 7 is connected to the first terminal unit 11 and a wiring line 15 connected to the control unit 10 is connected to the first terminal unit 11. Furthermore, the wiring line 8 is connected to the second terminal unit 12 and a wiring line connected to the control unit 10 is connected to the second terminal unit 12. As a result, the control unit 10 is capable of receiving transmission signals from the corresponding receiving devices 2 through the first terminal unit 11 and the second terminal unit 12, respectively. In addition, the control unit 10 is also capable of outputting signals to the corresponding receiving devices 2 through the first terminal unit 11 and the second terminal unit 12, respectively.

In the case where bus communication is performed as communication of multi-channel signals, it is sufficient to provide at least one terminal unit. When there is only one terminal unit, the inputs from the respective receiving devices 2 are merged into one output by a hub such as a three-way hub or the like.

The wiring line 9 is connected to the output-side terminal unit 14 and a wiring line 17 connected to the control unit 10 is connected to output-side terminal unit 14. Thus, the control unit 10 is capable of transmitting a signal to the drive control device 3 via the output-side terminal unit 14 and is capable of receiving a transmission signal from the drive control device 3.

The control unit 10 includes an information processing device such as a microcomputer provided with a CPU and a memory such as a ROM, a RAM or the like and executes various processes according to a program stored in the memory such as a ROM or the like.

The control unit 10 stores the signals inputted from the respective receiving devices 2 via the first terminal unit 11 and the second terminal unit 12 in the memory 13. The control unit 10 is capable of decoding the transmission signals (including the operation signals) from the respective receiving devices 2 stored in the memory 13 in this way.

In particular, the control unit 10 according to the embodiment executes processes for realizing the respective functions described below.

Figure 5:
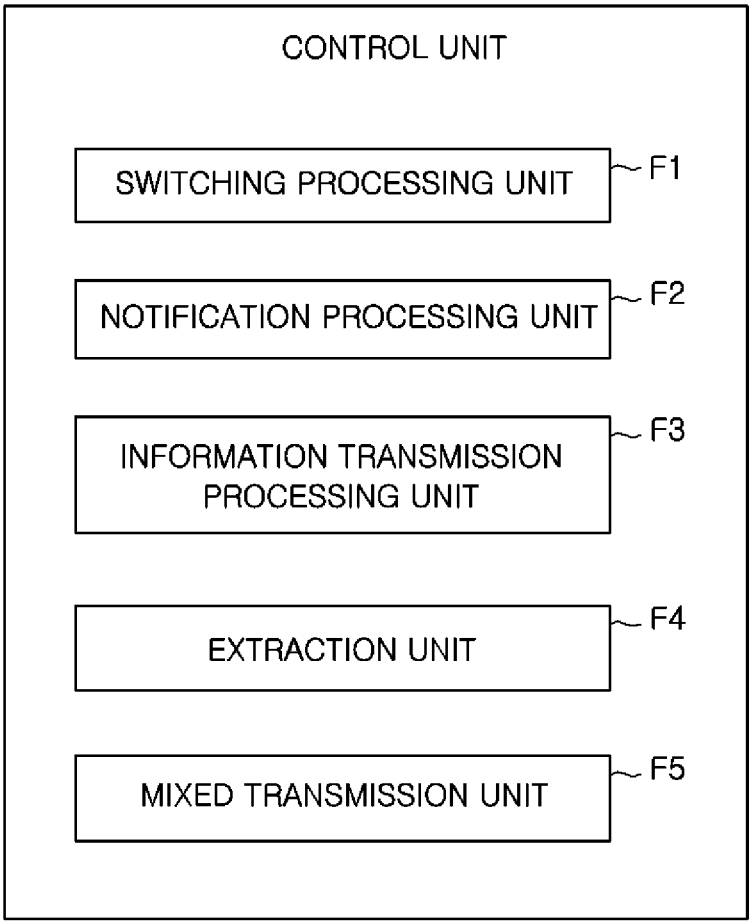
FIG. 5 is a functional block diagram of respective functions according to an embodiment realized by a control unit.

FIG. 5 is a functional block diagram showing the respective functions according to the embodiment realized by the control unit 10. It should be noted that at least a part of these functions can be realized by hardware.

As shown in FIG. 5, the control unit 10 can be expressed as having a switching processing unit F1, a notification processing unit F2, an information transmission processing unit F3, an extraction unit F4 and a mixed transmission unit F5 as functional blocks.

In this example, the processes for realizing the functions of the switching processing unit F1, the notification processing unit F2 and the information transmission processing unit F3 are executed by the control unit 10 in a corresponding relationship with a "normal mode" to be described later.

The switching processing unit F1 performs a process of switching the operation signal transmitted to the drive control device 3 from one of the operation signals inputted from the receiving devices 2 to another operation signal.

Specifically, the switching processing unit F1 performs switching of the operation signal transmitted to the drive control device 3, based on a specific operation signal transmitted by the transmitting device 101 according to a specific operation input of the operator.

In this regard, the transmitting device 101 (the control unit 110) transmits a specific operation signal in response to a specific operation (switching instruction operation) performed through the operation unit 111. The control unit 10 performs the above-described switching based on the specific operation signal transmitted from the transmitting device 101 and received by the corresponding receiving device 2 (the receiving device 2 of the link destination) in this way.

In the multi-channel signal communication standard applied to this example, a specific bit of a specific channel is allocated as a "switching instruction bit" indicating the presence or absence of the above-described specific operation (switching instruction operation). That is to say, when the specific operation as the switching instruction operation is performed in the transmitting device 101, the switching instruction bit in the transmission signal transmitted from the corresponding receiving device 2 to the communication control device 1 becomes ON (for example, "1").

The switching method performed by the switching processing unit F1 may include the following two methods.

First, a first method may be a method of, in accordance with the specific operation signal transmitted by the transmitting device 101 of the switching source, switching the specific operation signal to the operation signal from the transmitting device 101 other than the transmitting device 101 of the switching source.

In this regard, the transmitting device 101 of the "switching source" means the transmitting device 101 from which the operation signal is to be transmitted to the drive control device 3 at the stage before switching. In this example, the control unit 10 is set to transmit the operation signal from the primary side to the drive control device 3 during the period from the startup to the first switching. That is to say, during this period, the primary transmitting device 101 corresponds to "the transmitting device 101 from which the operation signal is to be transmitted to the drive control device 3". Thereafter, each time when switching is performed, the control unit 10 manages the transmitting device 101 of the "switching source". At this time, the identification of which transmitting device 101 has transmitted the operation signal inputted from the receiving device 2 can be realized by managing which of the first terminal unit 11 and the second terminal unit 12 has inputted the operation signal. Alternatively, such identification may be performed based on the communication ID included in the signal transmitted from the receiving device 2.

Hereinafter, the transmitting device 101 of the switching source and the corresponding receiving device 2 will be denoted as a "subject transmitting device" and a "subject receiving device", respectively, in terms of the fact that the transmitting device 101 and the receiving device 2 are subjects for transmitting the operation signal to the drive control device 3.

In the following description, the term "switching destination" is used. The transmitting device 101 of "switching destination" means the transmitting device 101 from which the operation signal is to be newly transmitted to the drive control device 3 by switching. In the case where two transmitting devices 101 are used as in this example, the transmitting device 101 of the switching destination is uniquely specified as the transmitting device 101 other than the transmitting device 101 of the switching source.

According to the first method of, in accordance with the specific operation signal transmitted by the transmitting device 101 of the switching source, switching the specific operation signal to the operation signal from the transmitting device 101 other than the transmitting device 101 of the switching source as described above, it is possible to perform switching while reflecting the intention of the operator of the switching source. Therefore, it is possible to prevent occurrence of confusion otherwise caused by performing the switching at a timing not intended by the operator of the switching source.

When adopting the first method, there is no guarantee that the transmitting device 101 of the switching destination is located within the receivable area. Therefore, the control unit 10 performs the switching under the condition that the transmission signal from the transmitting device 101 of the switching destination is received. Specifically, the switching is performed on the condition that the above-described reception status bit is ON in the transmission signal from the receiving device 2 linked to the transmitting device 101 of the switching destination. This switching is one form of switching according to the reception state of the operation signal.

The second method is a method of switching the specific operation signal to the operation signal from the transmitting device 101 that has transmitted the specific operation signal. That is to say, when the specific operation signal is transmitted from the primary side, switching to the primary side is performed. When the specific operation signal is transmitted from the secondary side, switching to the secondary side is performed.

Thus, when performing the switching, it is not necessary to confirm whether the transmitting device 101 of the switching destination is in a receivable state. This makes it possible to reduce the processing burden at the time of performing the switching.

Furthermore, the switching processing unit F1 performs not only switching in response to the operation described above but also automatic switching based on the duration of the state in which the operation signal transmitted by the transmitting device 101 of the switching source is unreceivable. More specifically, as the state in which the operation signal transmitted by the transmitting device 101 of the switching source is unreceivable continues for a predetermined time (e.g., 2 seconds) or more, the switching processing unit F1 switches the operation signal to be transmitted to the drive control device 3 from the operation signal transmitted from the switching source to the operation signal transmitted from the switching destination.

Thus, it is possible to automatically (not manually) perform the switching before a state in which it is difficult for the transmitting device 101 of the switching source to properly operate the radio control model 102 lasts for a relatively long time. This makes it possible to enhance the safety.

In the above automatic switching, switching is performed based on the duration of the unreceivable state. It is therefore possible to prevent frequent occurrence of automatic switching. For example, when the radio control model 102 is located in the vicinity of the boundary of the receivable areas Ar1 and Ar2, there is a possibility that the reception state from both transmitting devices 101 becomes unstable. If switching is automatically performed merely because the operation signal is unreceivable from one of the transmitting devices 101, there is a possibility that switching occurs frequently. The above-described automatic switching method is particularly effective in such a case.

Subsequently, in order to make sure that notification information is transmitted to the transmitting device 101 (namely, the above-described subject transmitting device) serving as the subject for transmitting the operation signal to the drive control device 3 among the plurality of transmitting devices 101, the notification processing unit F2 transmits information to the receiving device 2 (subject receiving device) corresponding to the transmitting device 101 serving as the transmission subject.

In this example, as the standard of the transmission signal transmitted from the receiving device 2 to the transmitting device 101, a predetermined bit of a predetermined channel is allocated as a "notification information bit" for storing the aforementioned notification information. The notification processing unit F2 transmits a transmission signal, in which the predetermined bit is caused to become ON (for example, "1"), to the receiving device 2 as the subject receiving device. As a result, the notification information is transmitted to the transmitting device 101 as the subject transmitting device via the receiving device 2. The transmitting device 101 (the control unit 110) having received the notification information causes the display unit 113 to display predetermined information. Thus, it is possible to confirm that the operator of the transmitting device 101 has the authority of operating the radio control model 102.

In the case of this example, the subject receiving device at the time of startup of the control unit 10 is the receiving device 2 on the primary side. Therefore, during the period from the startup to the first switching, the notification processing unit F2 causes the notification information bit of the transmission signal transmitted to the receiving device 2 on the primary side to become ON ("1") while causing the notification information bit of the transmission signal transmitted to the receiving device 2 on the secondary side to become OFF ("0"). Thereafter, each time when switching is performed, the notification processing unit F2 switches the value of the notification information bit in the transmission signal transmitted to each receiving device 2.

In order to transmit, to one of the transmitting devices 101, the reception level information on the operation signal transmitted by the other transmitting device 101, the information transmission processing unit F3 transmits information to the receiving device 2 corresponding to the other transmitting device 101. Specifically, in this case, the information transmission processing unit F3 transmits the reception level information received from the corresponding receiving device 2 to both of the receiving devices 2.

Upon receiving the reception level information, the receiving device 2 transmits the reception level information to the transmitting device 101 of the link destination. The transmitting device 101 causes the display unit 113 to display level indication information (e.g., a numerical value or an illustration indicating a reception level) based on the received reception level information. Thus, the operators of both transmitting devices 101 can confirm the reception state of the other party.

Accordingly, at the time of switching, the operator of the switching source can determine whether the switching destination is in a switchable state in terms of the reception level. In addition, the operator of the switching destination can grasp the reception level of the switching source. Therefore, particularly when it is difficult to communicate with the operator existing far away from the switching source, the operator of the switching destination can determine whether switching is about to be performed from now.

The extraction unit F4 and the mixed transmission unit F5 realize a function corresponding to a case where the drive control device 3 is set to the "second mode" described above.

When the drive control device 3 is used in the "second mode", the transmitting device configured to be able to operate an actuator device (an actuator device for adjusting a camera angle) serving as the second driving unit 5 is used as one of the two transmitting devices (in this example, the secondary side transmitting device). In this example, among the eight channels for serial communication, the minimum number of channels required for the drive control of the first driving unit 4 is four channels. Furthermore, the number of channels allocated for the drive control of the second driving unit 5 is four channels.

In this case, the control unit 10 includes, as operation modes, a "normal mode" in which the switching processing unit F1 selectively switches and outputs signals of eight channels to the drive control device 3 and a "mixing mode" in which signals of predetermined channels among the transmission signals transmitted from the respective receiving devices are mixed and outputted to the drive control device 3 in a corresponding relationship with the second mode described above.

The setting of the "normal mode" and the "mixing mode" are performed based on the operation by the operator. For example, the setting of the "normal mode" and the "mixing mode" are performed by connecting the communication control device 1 and the transmitting device 101 (or the transmitting device capable of adjusting the aforementioned camera angle) with a cable and performing an operation through the operation unit 111.

Figure 6:
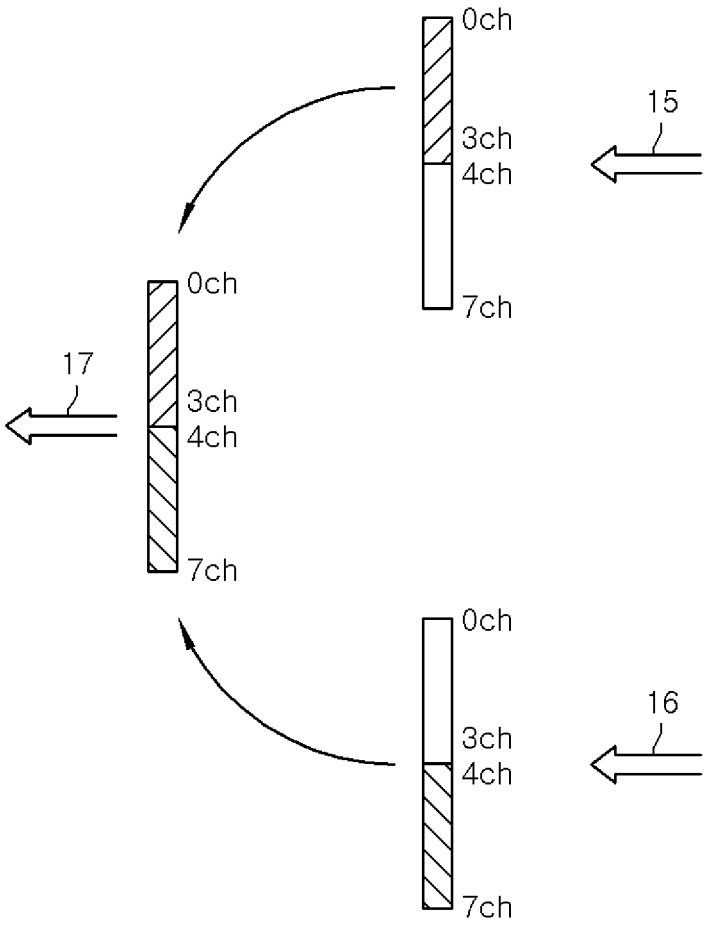
FIG. 6 is a diagram for explaining an operation in a mixing mode realized by an extraction unit and a mixed transmission unit.

FIG. 6 is a diagram for explaining the operation in the mixing mode realized by the extraction unit F4 and the mixed transmission unit F5. In the description made here, it is assumed that the primary side (the side connected to the first terminal unit 11) is the side on which the operation related to the first driving unit 4 is performed and the secondary side is the side on which the operation related to the second driving unit 5 is performed.

The extraction unit F4 extracts 0-channel to 3-channel signals out of the 8 channel signals (on the primary side) and extracts 4-channel to 7-channel signals out of the 8 channel signals (on the secondary side) inputted via the wiring line 16. The channels to be extracted on the primary side and the secondary side may be appropriately set according to the actual embodiment and are not limited to the above example.

The mixed transmission unit F5 allocates the signals extracted by the extraction unit F4 to the corresponding channels among the eight channels and transmits the signals to the drive control device 3 via the wiring line 17 (and the output-side terminal unit 14). Specifically, the signals of four channels extracted from the primary side are allocated to 0-channel to 3-channel. The signals of four channels extracted from the secondary side are allocated to the remaining 4-channel to 7-channel. Thus, the transmission signals to the drive control device 3 are generated and outputted from the wiring line 17.

By allocating the predetermined signals to the predetermined channels in this manner, the drive control device 3, in which the second mode is set, can properly drive and control the first driving unit 4 and the second driving unit 5, respectively.

That is to say, it is possible to properly realize a method of sharing the operations of the first driving unit 4 and the second driving unit 5 on the primary side and the secondary side, respectively.

(1-5. Processing Procedure)

Subsequently, a specific processing procedure to be executed to realize the respective functions according to the above-described embodiment will be described with reference to the flowcharts shown in FIGS. 7 to 9.

The process for realizing the function as the information transmission processing unit F3 is a process performed with respect to each receiving device 2, in which the reception level information received from one receiving device 2 is transmitted to the other receiving device 2. Since there is no need to make a flowchart, the illustration thereof is omitted.

Likewise, the process in the above-described mixing mode is a process in which signals of predetermined channels are extracted from the multi-channel signals transmitted from the respective receiving devices 2 in accordance with the setting of the mixing mode and in which the signals are allocated to predetermined channels and transmitted to the drive control device 3. Since there is no need to make a flowchart, the illustration thereof is omitted.

Figure 7:
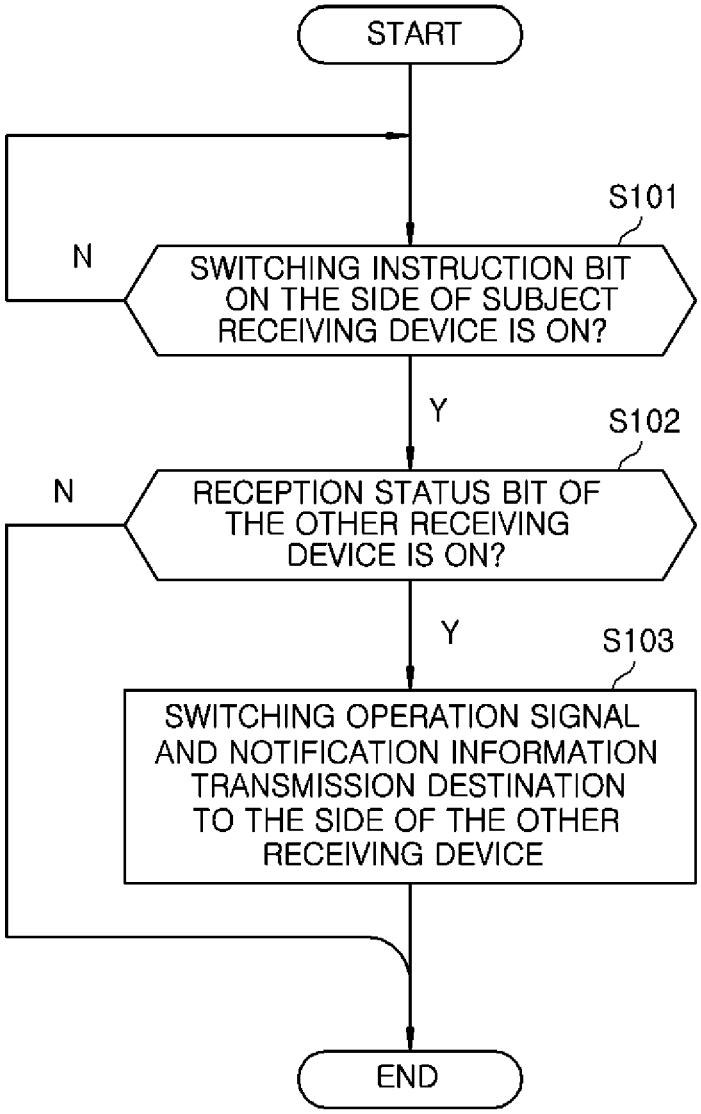
FIG. 7 is a flowchart showing a process corresponding to a first method of manual switching.
Figure 8:
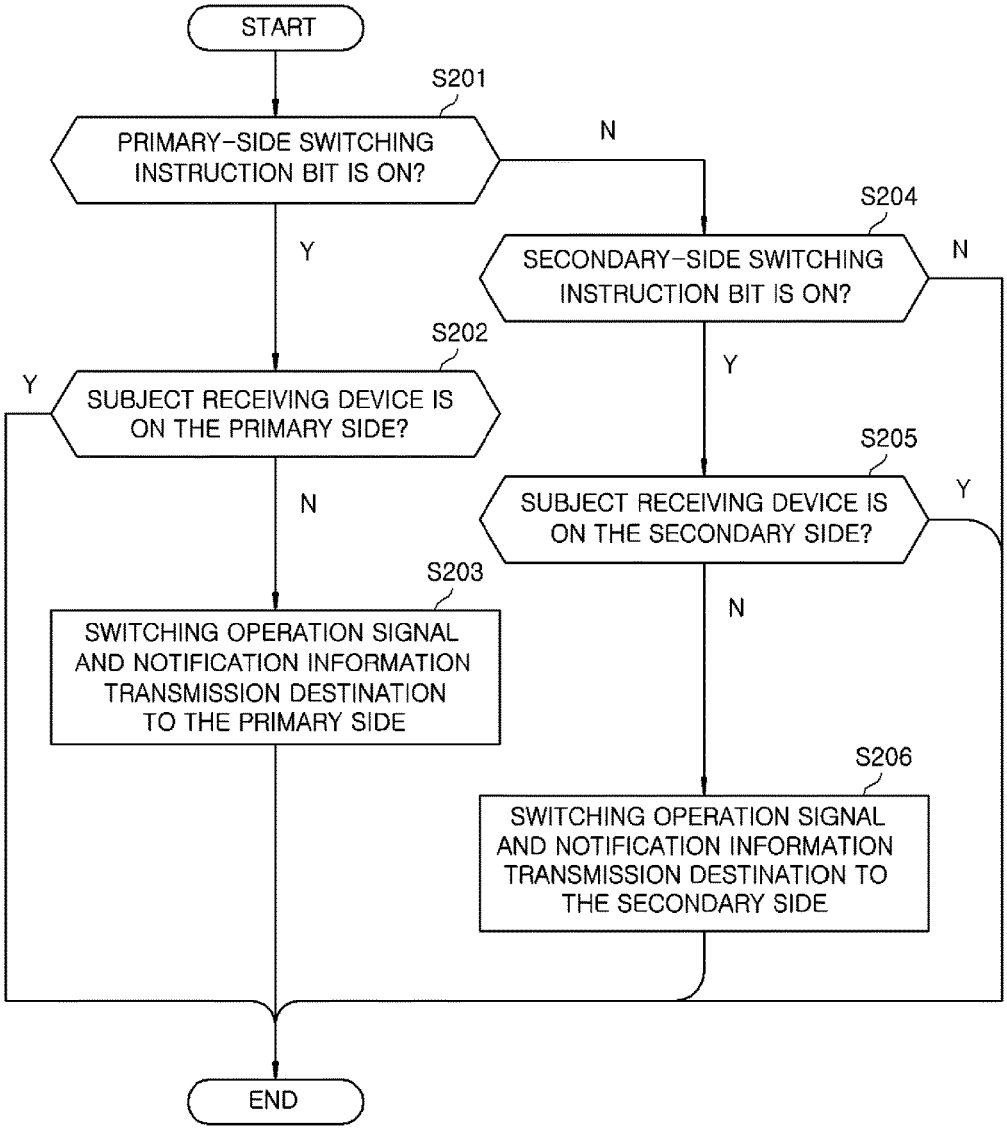
FIG. 8 is a flowchart showing a process corresponding to a second method of manual switching.
Figure 9:
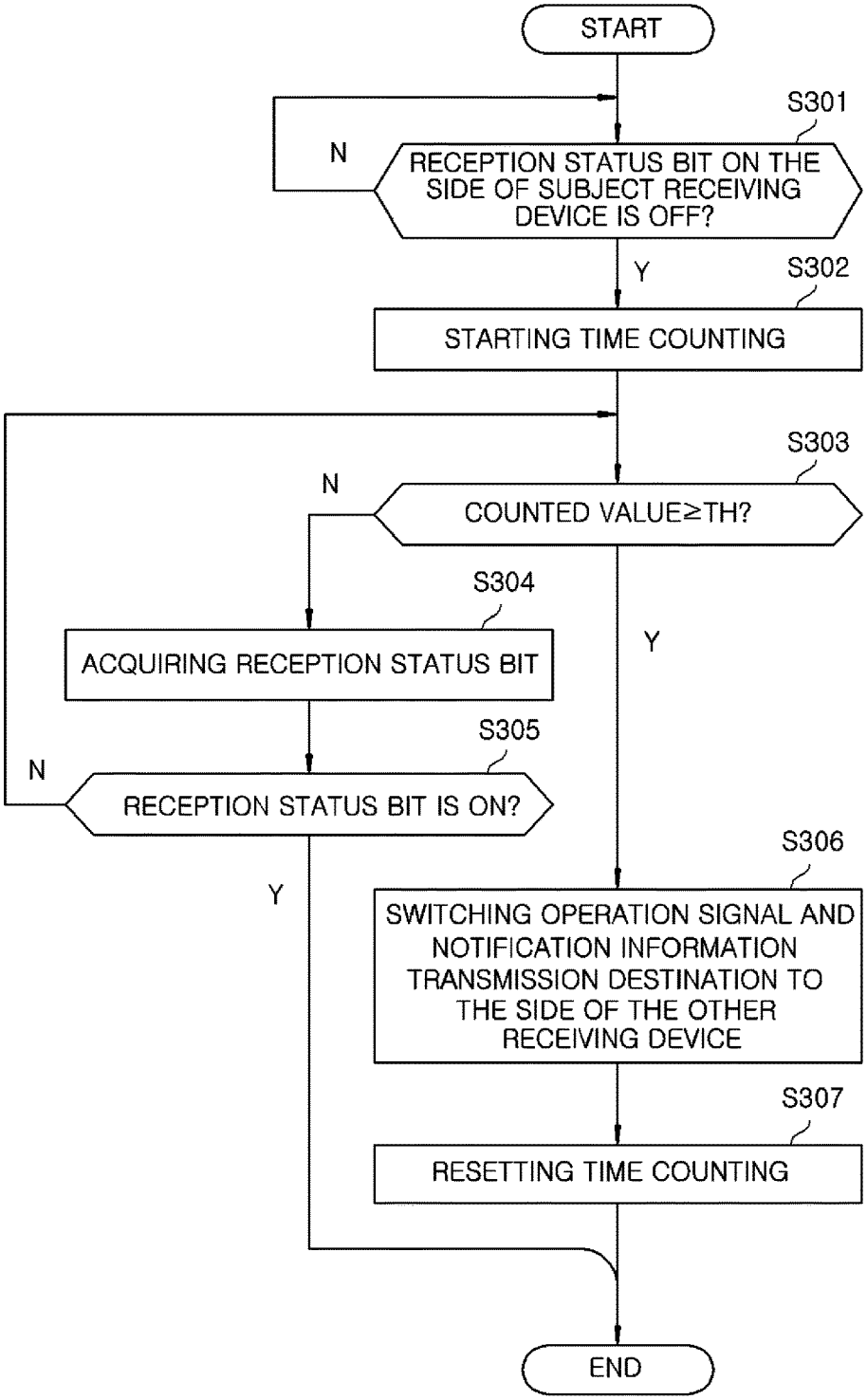
FIG. 9 is a flowchart showing a process for automatic switching according to a reception state.

FIGS. 7 to 9 show processes corresponding to the switching processing unit F1. FIG. 7 shows a process in the case of adopting the above-described first method. FIG. 8 shows a process in the case of adopting the second method. FIG. 9 shows a process for performing automatic switching according to the reception state.

The control unit 10 performs the process shown in FIG. 9 in parallel with the process shown in FIG. 7 or 8.

Referring first to FIG. 7, in step S101, the control unit 10 waits until the switching instruction bit on the subject receiving device (switching source) side becomes ON. When the switching instruction bit becomes ON, the control unit 10 determines in step S102 whether the reception status bit of the other receiving device 2 (switching destination) is ON. If the reception status bit is not ON, the control unit 10 terminates the process shown in FIG. 7. That is to say, when the operation signal from the transmitting device 101 of the switching destination is in an unreceivable state, switching is not performed.

On the other hand, if the reception status bit is ON, the control unit 10 proceeds to step S103 and performs a process for switching the operation signal and the notification information transmission destination to the side of the other receiving device 2, thereby terminating the process shown in FIG. 7.

Specifically, in step S103, the operation signal transmitted to the drive control device 3 is switched to the operation signal inputted from the receiving device 2 (the receiving device 2 of the switching destination) other than the subject receiving device. The control unit 10 performs a process of switching the notification information bit in the transmission signal to the receiving device 2 of the switching destination from OFF to ON and switching the notification information bit in the transmission signal to the receiving device 2 of the switching source from ON to OFF.

Referring to FIG. 8, in step S201, the control unit 10 determines whether the primary side switching instruction bit is ON. If the primary side switching instruction bit is not ON, in step S204, the control unit 10 determines whether the secondary side switching instruction bit is ON. If the secondary side switching instruction bit is not ON, the control unit 10 terminates the process shown in FIG. 8 (because the switching instruction operation is not performed in any transmitting device 101).

If the primary side switching instruction bit is ON in step S201, the control unit 10 proceeds to step S202 and determines whether the primary side is the subject receiving device. If the primary side is the subject receiving device, the control unit 10 terminates the process shown in FIG. 8. In other words, in this case, the switching instruction operation has been performed on side of the subject transmitting device. Thus, there is no need to perform switching.

On the other hand, if the primary side is not the subject receiving device, the control unit 10 performs a process of switching the operation signal and notification information transmission destination to the primary side in step S203, thereby terminating the process shown in FIG. 8.

In addition, when the secondary side switching instruction bit is ON in the previous step S204, the control unit 10 proceeds to step S205 and determines whether the secondary side is the subject receiving device. If the secondary side is the subject receiving device, the control unit 10 terminates the process shown in FIG. 8. If the secondary side is not the subject receiving device, the control unit 10 performs a process of switching the operation signal and the notification information transmission destination to the secondary side in step S206, and terminates the process shown in FIG. 8.

Referring next to FIG. 9, in step S301, the control unit 10 waits until the reception status bit on the subject receiving device side becomes OFF. If the reception status bit becomes OFF, the control unit 10 starts time counting in step S302 and determines in step S303 whether a counted value (time counted value) is equal to or larger than a threshold value TH. In this example, a value corresponding to, for example, 2 seconds, is set as the threshold value TH.

If it is determined in step S303 that the counted value is not equal to or larger than the threshold value TH, the control unit 10 proceeds to step S304 to acquire the reception status bit on the subject receiving device. In the subsequent step S305, the control unit 10 determines whether the reception information bit is ON. If the reception status bit is ON, the control unit 10 resets the time count in step S307 and terminates the process shown in FIG. 9.

That is to say, even when the operation signal from the subject transmitting device becomes unreceivable, automatic switching is not performed if the unreceivable state temporary.

On the other hand, if the reception information bit is not ON in step S305, the control unit 10 returns to the previous step S303. In other words, it is possible to count the duration of the state in which the operation signal from the subject transmitting device is unreceivable.

If the counted value is equal to or larger than the threshold value TH in step S303, the control unit 10 proceeds to step S306 and performs a process of switching the operation signal and notification information transmission destination to the other receiving device side. In the subsequent step S307, the control unit 10 resets the count and terminates the process shown in FIG. 9.

In the above description, the first method (switching to the switching destination in response to the operation of the switching source) and the second method (switching to the side on which the switching instruction operation is performed) are cited as a manual switching method. Particularly, in the case where there are two sets of the transmitting devices 101 and the receiving devices 2 as in this example, it may be possible to perform switching in response to only a specific operation signal from a specific one of the two transmitting devices 101. For example, only the primary-side transmitting device 101 is capable of accepting and transmitting a switching instruction operation. The communication control device 1 performs the switching of the operation signal to be transmitted to the drive control device 3, in response to a specific operation signal inputted from the primary-side receiving device 2.

Regarding the reception level information, the reception level information of the switching destination may be transmitted only to the switching source. Conversely, it is also possible to transmit the reception level information of the switching source only to the switching destination.

If the reception level information of the switching destination is transmitted to the switching source, the operator of the switching source can determine whether the switching destination is in a switchable state in terms of the reception level. Moreover, if the reception level information of the switching source is transmitted to the switching destination, the operator of the switching destination can determine whether switching is about to be performed from now, particularly when it is difficult to communicate between the operators existing far away from the switching source.

2. MODIFICATIONS OF THE EMBODIMENT

(2-1. Modification 1)

In the above description, there has been illustrated the case where there are two sets of the transmitting devices 101 and the receiving devices 2. However, there may be provided three or more sets of the transmitting devices 101 and the receiving devices 2.

Figure 10:
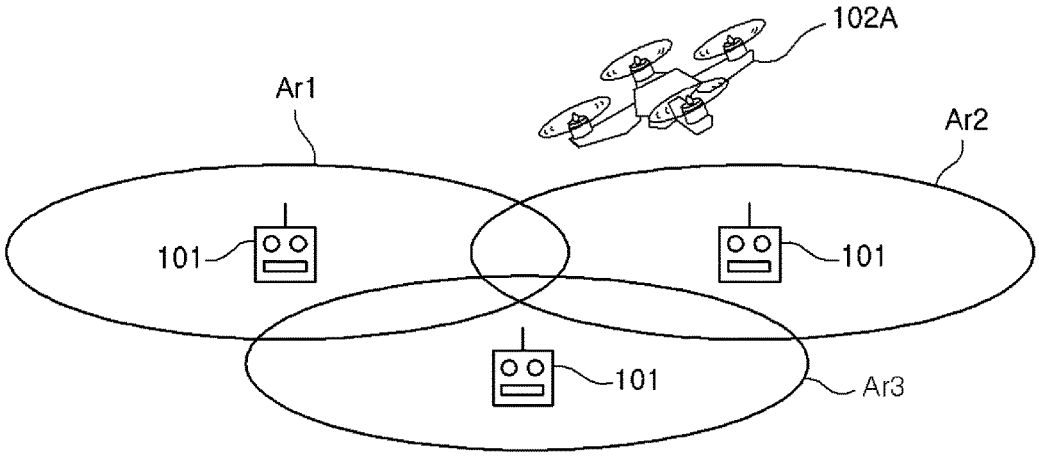
FIG. 10 is a view showing an external configuration example of a radio control system according to modification 1.
Figure 11:
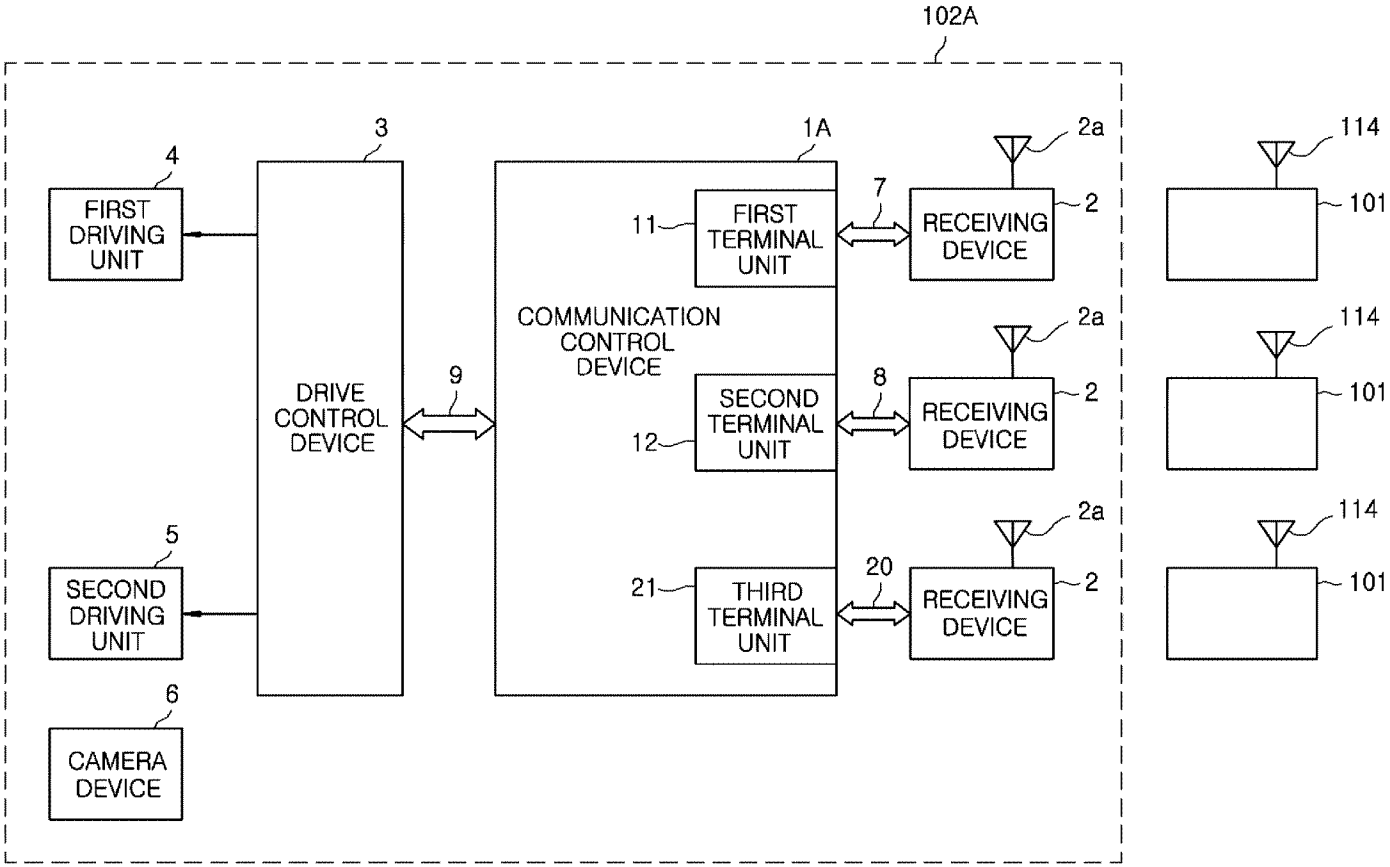
FIG. 11 is a block diagram of the radio control system according to modification 1.

FIGS. 10 and 11 show an external configuration example and a block diagram of a radio control system 100A including three sets of transmitting devices 101 and receiving devices 2. As shown in FIG. 11, the radio control system 100A is provided with a radio control model 102A in place of the radio control model 102. The radio control model 102A is equipped with three receiving devices 2 and is provided with a communication control device 1A in place of the communication control device 1. The communication control device 1A is provided with a third terminal unit 21 for connecting the third receiving device 2. In FIG. 11, the wiring line for interconnecting the third terminal unit 21 and the receiving device 2 is shown as a wiring line 20.

In FIG. 10, the receivable areas Ar (Ar1 to Ar3) of the three transmitting devices 101 are schematically shown. It can be understood that as compared with FIG. 1, the number of the sets of the transmitting devices 101 and the receiving devices 2 is increased to expand the area in which the radio control model 102A can be operated.

In the case where there are three or more sets of the transmitting devices 101 and the receiving devices 2, when switching is performed by the aforementioned first method, the instruction of the transmission device 101 as the switching destination together with the instruction of the switching itself is required as the switching instruction performed by the switching source because there are two or more transmitting devices 101 other than the switching source. That is to say, the switching instruction operation is an operation including designation of the transmitting device 101 as the switching destination.

In this case, the control unit 10 switches the operation signal transmitted to the drive control device 3, to the operation signal inputted from the receiving device 2 corresponding to the designated transmitting device 101, in response to the switching instruction from the receiving device 2 of the switching source accompanied by the designation of the switching destination. At this time, when performing the same process as in step S102, it is determined whether the reception status bit corresponding to the transmitting device 101 designated as the switching destination is ON.

In the case where there are three or more sets of the transmitting devices 101 and the receiving devices 2, when switching is performed by the aforementioned second method, it is determined whether each of the switching instruction bits of the signals inputted from the respective receiving devices 2 is ON. Switching is performed to the operation signal transmitted from the receiving device 2 whose switching instruction bit is ON.

If the second method is adopted in the case where there are three or more sets of the transmitting devices 101 and the receiving devices 2, there is an advantage that the designation of the switching destination is not necessary in the switching instruction. Furthermore, according to the second method described above, there is an advantage that at the time of switching, it is not necessary to confirm whether the transmitting device 101 of the switching destination is in a receivable state.

In the case where there are three or more sets of the transmitting devices 101 and the receiving devices 2, when automatic switching is performed to the operation signal transmitted from the other transmitting device 101 depending on the reception state of the switching source, it is conceivable that, for example, switching is performed to the operation signal having the maximum reception level among the operation signals other than the switching source.

(2-2. Modification 2)

In the above description, the condition for switching the operation signal includes the condition that the switching instruction is made and the switching destination is in a receivable state. However, the switching condition of the operation signal may include a condition based on the driving amount of the driving target represented by the operation signal. In this regard, the driving target refers to a target to be driven based on the operation signal. In the examples of FIGS. 3 and 11, the first driving unit 4 and the second driving unit 5 correspond to the driving target. The driving amount can be detected by decoding the operation signal.

The specific switching condition may be, for example, a condition that the difference between the driving amounts represented by the operation signal of the switching source and the operation signal of the switching destination is not more than a predetermined value.

As the control unit 10 performs switching of the operation signal under such a condition, it is possible to prevent the driving amount of the driving target from relatively greatly deviating before and after the switching and to avoid a danger that may occur along with the switching.

Alternatively, the switching condition based on the driving amount may be a condition that the driving amount represented by the switching signal of the switching destination is not more than a predetermined value. As the control unit 10 performs switching of the operation signal under such a condition, it is possible to prevent the switching from being performed in a state in which the driving amount represented by the operation signal of the switching destination greatly deviates from the assumed driving amount at the time of switching. It is possible to avoid a danger that may occur along with the switching.

In particular, when the driving amount is "0", the radio control model as a multi-copter comes into a hovering state in which the radio control model is stopped in the sky. Therefore, it is desirable that the operation signal is switched in such a hovering state. Accordingly, it is preferable to set the switching condition to the aforementioned condition. Even in other forms of radio control models, the aforementioned condition is preferred because it is not desirable to switch the operation signal during acceleration/deceleration, turning, or the like.

(2-3. Other)

In the above description, there has been illustrated the example in which the switching of the operation signal as in the normal mode is not performed in the mixing mode. However, the switching of the operation signal as in the normal mode may be performed even in the mixing mode.

Figure 12:
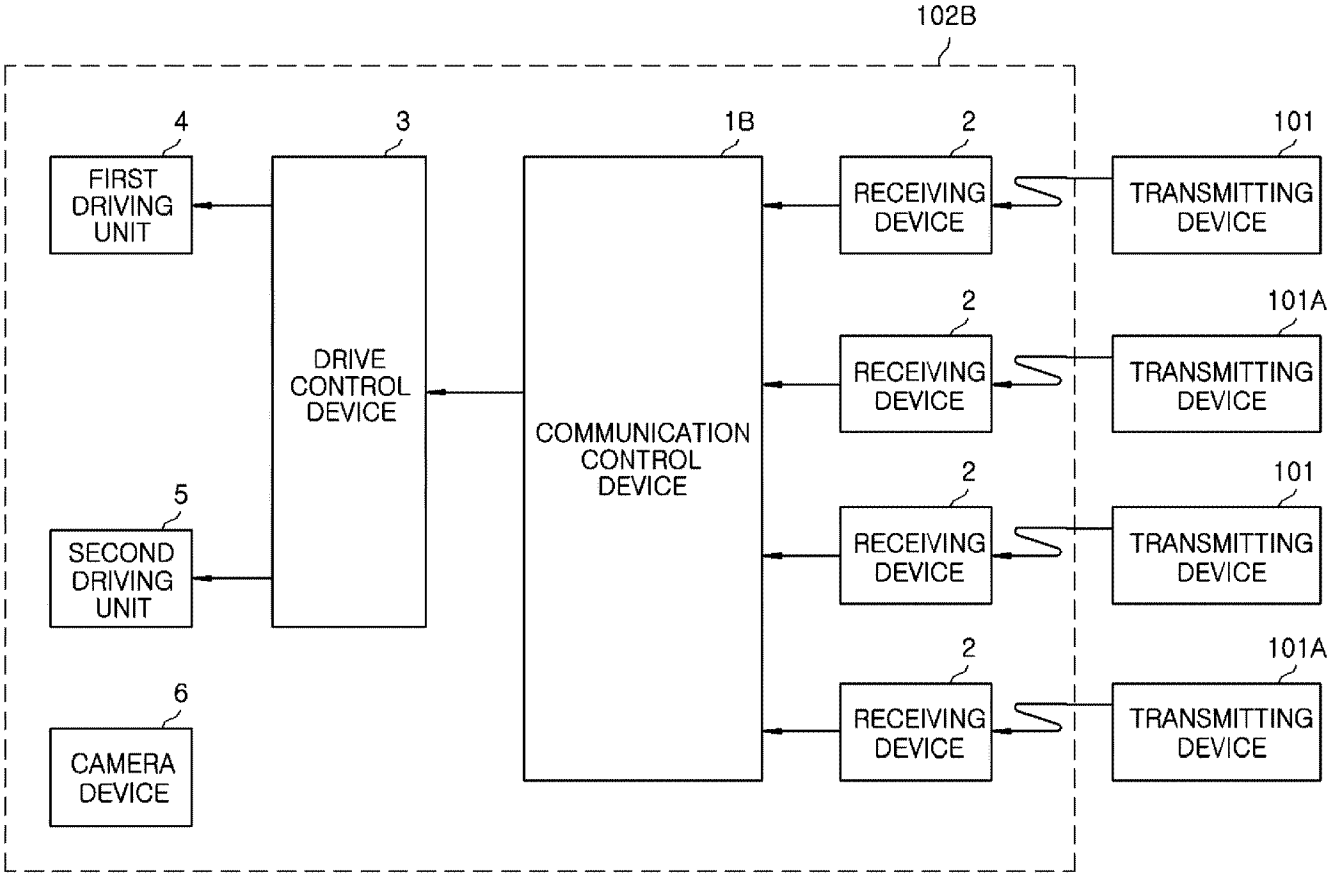
FIG. 12 is a block diagram showing a configuration example of a radio control system corresponding to a case of switching mixed signals.

For example, as shown in FIG. 12, it is assumed that a radio control model 102B is equipped with four receiving devices 2 and a communication control device 1B connected to these receiving devices 2. In FIG. 12, the transmitting device capable of adjusting a camera angle is denoted as a transmitting device 101A. Each of the transmitting devices 101 in FIG. 12 is linked with one receiving device 2 corresponding thereto. Each of the transmitting devices 101A is also linked with one receiving device 2 corresponding thereto.

In this case, for each of two sets of "the transmitting devices 101 and the receiving devices 2" and two sets of "the transmitting devices 101A and the receiving devices 2", the communication control device 1B is capable of mixing the operation signals from the transmitting devices 101 and 101A in the same manner as in the above-described mixing mode. For example, as a switching instruction operation is performed by the transmitting device 101 or the transmitting device 101A, the communication control device 1B switches the mixed signal to be transmitted to the drive control device 3, to the mixed signal generated with respect to the set on which the switching instruction operation is performed. In this case, the mixed signal may be generated only for one set as the switching destination.

In the above description, there has been illustrated the example in which the second method is applied to the switching of the mixed signal. It goes without saying that the first method may be applied. Furthermore, switching may be performed based on the above-described reception state or the driving amount represented by the operation signal. At that time, as for the reception state and the driving amount, it may be possible to refer to those for one or both of the transmitting devices 101 and 101A.

Furthermore, the above-described notification information and reception level information may be transmitted. In that case, the notification information and the reception level information may be transmitted to one or both of the transmitting devices 101 and 101A.

The second driving unit 5 is not limited to the actuator device for adjusting the camera angle but may be any other device such as, for example, an actuator device for driving an arm unit or a wire winding unit of a crane mechanism for pulling up a target object on the ground.

When switching the operation signal, it is also possible to take over the control signal of the switching source as the control signal of the switching destination at a predetermined time after establishment of the switching condition.

There may be a case where the operator of the switching destination does not notice that the switching has been performed. This method has an advantage that it is possible to prevent the non-operation period from lasting over a long time in such a case.

Regarding the information transmission from the communication control device 1 (1A or 1B) to the transmitting device 101 (101A), the information indicating which transmitting device 101 is the switching source may be transmitted to the transmitting device 101 other than the switching source.

3. SUMMARY OF THE EMBODIMENT

As described above, the communication control device (1, 1A or 1B) according to the embodiment is a communication control device for a radio control model equipped with a plurality of receiving devices (2) configured to receive operation signals from corresponding transmitting devices (101 or 101A) and a drive control device (3) configured to perform drive control with respect to a driving target (a first driving unit 4 or a second driving unit 5) based on the operation signals, the communication control device comprising: an input unit (a first terminal unit 11 or a second terminal unit 12) configured to input signals including the operation signals from the receiving devices; and a switching processing unit (F1) configured to perform a process of switching an operation signal to be transmitted to the drive control device from any one of the operation signals inputted by the receiving devices to another operation signal.

As described above, by performing the switching of the operation signals inputted from the receiving devices in the case of using the plurality of receiving devices configured to receive the operation signals from the corresponding transmitting devices, it is possible to smoothly perform the switching of the transmitting devices.

Accordingly, it is possible to improve the safety in enabling the transmitting devices to alternately operate a common radio control model.

The communication control device having the above configuration is used in an existing radio control system including a transmitting device, a receiving device and a drive control device in a state in which the communication control device is interposed between the receiving device and the drive control device. It is possible for a user to enjoy the functions of the present device without newly purchasing the receiving device and the drive control device constituting the existing system.

In the communication control device according to the embodiment, the switching processing unit is configured to perform the switching based on a specific operation signal transmitted by one of the transmitting devices in response to a specific operation input and received by the receiving device corresponding to the one of the transmitting devices. As a result, the switching can be performed while reflecting the intention of the operator. Consequently, it is possible to prevent occurrence of confusion which may be caused by performing the switching at a timing not intended by the operator.

In the communication control device according to the embodiment, the switching processing unit is configured to, in response to the specific operation signal transmitted by the transmitting device of a switching source, perform switching to an operation signal transmitted from a transmitting device other than the transmitting device of the switching source.

As a result, the switching can be performed while reflecting the intention of the operator of the switching source. Consequently, it is possible to prevent occurrence of confusion which may be caused by performing the switching at a timing not intended by the operator of the switching source.

In the communication control device according to the embodiment, the switching processing unit is configured to perform switching to an operation signal transmitted from the transmitting device which has transmitted the specific operation signal.

This eliminates the need to, when performing the switching, check whether the transmitting device of the switching destination is in a receivable state. It is therefore possible to reduce the processing burden at the time of switching. In the case where there are three or more transmitting devices, it is not necessary to have the operator perform an operation of designating the transmitting device of the switching destination. This makes it possible to reduce the operation burden borne by the operator at the time of switching.

In the communication control device according to the embodiment, the switching processing unit is configured to perform the switching based on a reception state of the operation signal transmitted by each of the transmitting devices.

As a result, it is possible to prevent the switching from being performed in a state in which it is difficult for the transmitting device of the switching destination or the switching source to appropriately perform the model operation. Accordingly, it is possible to improve the safety.

In the communication control device according to the embodiment, the switching processing unit is configured to perform the switching based on the duration of a state in which an operation signal transmitted by the transmitting device of a switching source is unreceivable.

Thus, it is possible to automatically (not manually) perform the switching before a state in which it is difficult for the transmitting device of the switching source to properly operate the radio control model lasts for a relatively long time. This makes it possible to enhance the safety.

The switching is performed based on the duration of the unreceivable state, and it is therefore possible to prevent frequent occurrence of automatic switching.

In the communication control device according to the embodiment, each of the receiving devices is configured to be able to perform bidirectional communication with each of the transmitting devices and the communication control device, and the communication control device further comprises: a notification processing unit (F2) configured to perform information transmission to the receiving device corresponding to one of the transmitting devices serving as a subject for transmitting an operation signal to the drive control device so that notification information is transmitted to one of the transmitting devices serving as the transmission subject for the operation signal.

As a result, the fact that the radio control model is operable can be notified to the operator of one of the transmitting devices currently capable of operating the radio control model.

Accordingly, at the time of switching, it is possible to enable the operator of the switching destination to recognize that the operation authority has been transferred to him or her. During the operation after switching, it is possible to enable the operator of the switching destination to confirm the state that the operation authority has been transferred to him or her.

The communication control device according to the embodiment further comprises: an information transmission processing unit (F3) configured to perform information transmission to the receiving device corresponding to another transmitting device so that reception level information on the operation signal transmitted by the another transmitting device is transmitted to one of the transmitting devices.

As a result, when there are two transmitting devices, the operator of one of the switching source and the switching destination can grasp the reception level of the other party. If the reception level information of the switching destination is transmitted to the switching source, the operator of the switching source can determine whether the switching destination is in a switchable state in terms of the reception level. Moreover, if the reception level information of the switching source is transmitted to the switching destination, the operator of the switching destination can determine whether switching is about to be performed from now, particularly when it is difficult to communicate between the operators existing far away from the switching source.

When there are three or more transmitting devices, if the reception level information of another transmitting device is transmitted to the switching source, the operator of the switching source can easily determine to which transmitting device is to be switched. In addition, if the reception level information of the switching source is transmitted to the transmitting device other than the switching source, the operator other than the switching source can easily determine whether switching to him or her is about to be performed from now, particularly when it is difficult to communicate between the operators existing far away from the switching source. In this manner, by making sure that, to one of the transmitting devices, the reception level information of the operation signal transmitted by another transmitting device is transmitted, it is possible to prevent confusion of the operator at the time of switching.

In the communication control device according to the embodiment, each of a first signal transmission path as a signal transmission path leading to each of the receiving devices and a second signal transmission path as a signal transmission path leading to the drive control device has a plurality of transmission channels, and the communication control device further comprises: an extraction unit (F4) configured to extract a transmission signal of a part of the transmission channels allocated to each of the receiving devices from transmission signals inputted to the receiving devices by the input unit via the first signal transmission path; and a mixed transmission unit (F5) configured to allocate the transmission signal extracted by the extraction unit to the corresponding part of the transmission channels of the second signal transmission path and transmit the allocated transmission signal to the drive control device.

Thus, the transmission signals from the respective transmitting devices are transmitted to the drive control device in a state in which the transmission signals are allocated to the predetermined channels of the second signal transmission path. Accordingly, it is possible for a plurality of persons to share the operations of a plurality of driving targets mounted on the radio control model.

In the communication control device according to the embodiment, the switching processing unit is configured to perform the switching based on a driving amount of a driving target represented by an operation signal transmitted by one of the transmitting devices and received by the receiving device corresponding to the one of the transmitting devices.

As a result, at the time of switching, the driving amount of the driving target designated by the transmitting device of the switching source or another transmitting device capable of becoming the switching destination is taken into consideration.

Accordingly, it is possible to prevent occurrence of such a situation that the switching is performed in a driving state in which the driving amount of the driving target is excessively deviated before and after the switching or the driving amount of the driving target is greatly deviated from a driving amount assumed at the time of switching. This makes it possible to avoid a danger that may occur along with the switching.

In the communication control device according to the embodiment, the switching processing unit is configured to perform the switching under a condition that a difference between a driving amount represented by an operation signal transmitted by the transmitting device of a switching source and received by the receiving device corresponding to the transmitting device of the switching source and a driving amount represented by an operation signal transmitted by the transmitting device other than the switching source and received by the receiving device corresponding to the transmitting device other than the switching source is equal to or smaller than a predetermined value.

This makes it possible to prevent the driving amount of the driving target from relatively greatly deviating before and after the switching. Accordingly, it is possible to avoid a danger which may occur along with the switching.

In the communication control device according to the embodiment, the switching processing unit is configured to perform the switching on a condition that a driving amount represented by an operation signal transmitted by the transmitting device of a switching source and received by the receiving device corresponding to the transmitting device of the switching source is equal to or smaller than a predetermined value.

As a result, it is possible to prevent the switching from being performed in a state in which the driving amount represented by the operation signal of the switching destination is greatly deviated from a driving amount assumed at the time of switching. This makes it possible to avoid a danger that may occur along with the switching.

4. OTHER MODIFICATIONS

While the embodiment of the present invention has been described above, the present invention is not limited to the specific embodiment described above. Various modifications are conceivable.

For example, the form of the radio control model to which the present invention is applied is not limited to the form of the multicopter exemplified above but may be in the form of a helicopter, a car, a ship, a robot, etc. The specific form is not particularly limited.

In addition, the actuator device used for the driving unit is not limited to a motor device such as a servomotor or the like but may be a device provided with other actuator such as, e.g., a solenoid or a piezoelectric element.

In the above description, there has been illustrated the case where the number of channels of the signal transmission paths between the receiving device 2 and the communication control device 1 and between the communication control device 1 and the drive control device 3 is set to "8". However, the number of channels may be any plural number.

While the serial communication has been taken as an example of multi-channel signal transmission, time division communication may be performed instead of the serial communication. Furthermore, wireless communication instead of wired communication may be formed between the receiving device 2 and the communication control device 1 or between the communication control device 1 and the drive control device 3.

In the above description, there has been illustrated the case where the display unit is used as a means for causing the operator to perceive various kinds of information such as notification information or the like. However, a sound output means such as a speaker or the like may be provided so that various kinds of information can be perceived through a sound.

What is claimed is:

1. A communication control device for a radio control model equipped with a plurality of receiving devices configured to receive operation signals from corresponding transmitting devices and a drive control device configured to perform drive control with respect to a driving target based on the operation signals, the communication control device comprising:

an input unit configured to input signals including the operation signals from the receiving devices; and a switching processing unit configured to perform a process of switching any one of the operation signals inputted from the receiving devices to another operation signal, wherein said another operation signal is to be transmitted to the drive control device.

2. The communication control device of claim 1, wherein the switching processing unit is configured to perform the switching based on a specific operation signal transmitted by one of the transmitting devices in response to a specific operation input and received by the receiving device corresponding to the one of the transmitting devices.

3. The communication control device of claim 2, wherein the switching processing unit is configured to, in response to the specific operation signal transmitted by the transmitting device of a switching source, perform switching to an operation signal transmitted from a transmitting device other than the transmitting device of the switching source.

4. The communication control device of claim 2, wherein the switching processing unit is configured to perform switching to an operation signal transmitted from the transmitting device which has transmitted the specific operation signal.

5. The communication control device of claim 1, wherein the switching processing unit is configured to perform the switching based on a reception state of the operation signal transmitted by each of the transmitting devices.

6. The communication control device of claim 5, wherein the switching processing unit is configured to perform the switching based on the duration of a state in which an operation signal transmitted by the transmitting device of a switching source is unreceivable.

7. The communication control device of claim 1, wherein each of the receiving devices is configured to be able to perform bidirectional communication with each of the transmitting devices and the communication control device, and the communication control device further comprises:

a notification processing unit configured to perform information transmission to the receiving device corresponding to one of the transmitting devices serving as a subject for transmitting an operation signal to the drive control device so that notification information is transmitted to the one of the transmitting devices serving as the transmission subject for the operation signal.

8. The communication control device of claim 1, further comprising:

an information transmission processing unit configured to perform information transmission to the receiving device corresponding to another transmitting device so that reception level information on the operation signal transmitted by the another transmitting device is transmitted to one of the transmitting devices.

9. The communication control device of claim 1, wherein each of a first signal transmission path as a signal transmission path leading to each of the receiving devices and a second signal transmission path as a signal transmission path leading to the drive control device has a plurality of transmission channels, and the communication control device further comprises:

an extraction unit configured to extract a transmission signal of a part of the transmission channels allocated to each of the receiving devices from transmission signals inputted to the receiving devices by the input unit via the first signal transmission path; and a mixed transmission unit configured to allocate the transmission signal extracted by the extraction unit to a corresponding part of the transmission channels of the second signal transmission path and transmit the allocated transmission signal to the drive control device.

10. The communication control device of claim 1, wherein the switching processing unit is configured to perform the switching based on a driving amount of a driving target represented by an operation signal transmitted by one of the transmitting devices and received by the receiving device corresponding to the one of the transmitting devices.

11. The communication control device of claim 10, wherein the switching processing unit is configured to perform the switching under a condition that a difference between a driving amount represented by an operation signal transmitted by the transmitting device of a switching source and received by the receiving device corresponding to the transmitting device of the switching source and a driving amount represented by an operation signal transmitted by the transmitting device other than the switching source and received by the receiving device corresponding to the transmitting device other than the switching source is equal to or smaller than a predetermined value.

12. The communication control device of claim 10, wherein the switching processing unit is configured to perform the switching on a condition that a driving amount represented by an operation signal transmitted by the transmitting device of a switching source and received by the receiving device corresponding to the transmitting device of the switching source is equal to or smaller than a predetermined value.

* * * * *